US012029937B2

(12) United States Patent
Hall

(10) Patent No.: US 12,029,937 B2
(45) Date of Patent: Jul. 9, 2024

(54) SPEED BAG TYPE EXERCISE EQUIPMENT

(71) Applicant: Michael Rennee Hall, Sylmar, CA (US)

(72) Inventor: Michael Rennee Hall, Sylmar, CA (US)

( * ) Notice: Subject to any disclaimer, the term of this patent is extended or adjusted under 35 U.S.C. 154(b) by 148 days.

(21) Appl. No.: 17/703,676

(22) Filed: Mar. 24, 2022

(65) Prior Publication Data

US 2023/0302324 A1 Sep. 28, 2023

(51) Int. Cl.
*A63B 22/00* (2006.01)
*A63B 21/015* (2006.01)
*A63B 22/06* (2006.01)

(52) U.S. Cl.
CPC ..... *A63B 22/0005* (2015.10); *A63B 21/015* (2013.01); *A63B 22/0605* (2013.01); *A63B 2022/003* (2013.01); *A63B 2022/0033* (2013.01); *A63B 2022/0035* (2013.01); *A63B 2022/0652* (2013.01)

(58) Field of Classification Search
CPC ..... A63B 22/0005; A63B 21/015; A63B 22/0605; A63B 2022/003; A63B 2022/0033; A63B 2022/0035; A63B 2022/0652
See application file for complete search history.

(56) References Cited

U.S. PATENT DOCUMENTS 4,640,268 A * 2/1987 Roberts ..... A63B 21/06 601/24
4,842,269 A * 6/1989 Huang ..... A63B 22/0002 74/31
5,108,092 A 4/1992 Hurst
5,490,824 A 2/1996 Wang
5,647,822 A 7/1997 Avganim
5,647,822 A 7/1997 Avganim
6,589,139 B1 * 7/2003 Butterworth ..... B62M 3/02 74/594.1
8,007,412 B2 8/2011 Lofgren et al.
8,066,621 B2 * 11/2011 Carlson ..... A63B 23/025 482/8
9,592,421 B2 3/2017 Eder
11,266,873 B1 * 3/2022 Sherman ..... A63B 21/1609
2009/0253558 A1 * 10/2009 Lofgren ..... A63B 22/0002 482/51
2015/0258365 A1 * 9/2015 Neill ..... A63B 21/0125 482/54
2017/0120104 A1 * 5/2017 Douglass ..... A63B 21/4049
(Continued)

FOREIGN PATENT DOCUMENTS

CN 203736796 U 7/2014
KR 20150004603 U 12/2015

OTHER PUBLICATIONS https://www.merriam-webster.com/dictionary/ring (Year: 2024).*
(Continued)

*Primary Examiner* — Andrew S Lo
*Assistant Examiner* — Andrew M Kobylarz
(74) *Attorney, Agent, or Firm* — Perkins Coie LLP

(57) ABSTRACT

Exercise equipment includes an arm unit having left and right hand grips. The lateral centerlines of the hand grips are closely spaced together. In use, with the hands on the hand grips, the user revolves the hand grips in a circular motion simulating a speed bag punching type of movement.

23 Claims, 9 Drawing Sheets

(56) References Cited

U.S. PATENT DOCUMENTS

| | | | | |
|---|---|---|---|---|
| 2018/0154204 | A1* | 6/2018 | Bayerlein | A63B 22/0015 |
| 2020/0171345 | A1 | 6/2020 | Gonzalez | |

OTHER PUBLICATIONS

NISDOKR Pedal Exerciser, accessed Mar. 21, 2022 from https://www.amazon.com/NISDOKR-Exerciser-Exercise-Adjustable-Equipment/dp/B08S73BSDZ; 3 pages.

International Search Report and Written Opinion for International Application No. PCT/2023/015218; Date of Mailing: Jun. 29, 2023; 11 pages.

* cited by examiner

SPEED BAG TYPE EXERCISE EQUIPMENT

TECHNICAL FIELD

The field of the invention is exercise equipment. More specifically the invention relates to exercise equipment which allows for separate or simultaneous exercise of the upper body and the legs, with the arms performing a speed bag type of movement.

Many types of stationary bicycles allow for exercising the legs with a pedaling movement to rotate bicycle-type cranks on a sprocket. Some types also have a second set of rotating cranks generally at chest level, to allow for exercising the upper body, primarily the arms, as well.

Speed bag punching is a boxing move performed by moving the hands and arms in a circular motion. Speed bag punching targets shoulders, triceps, and lats, helping to tone and sculpt the upper body. It is also a vigorous cardiovascular exercise. In addition, speed bag punching is helpful for developing speed, agility, and coordination. However, speed bag punching requires intense focus, coordination and speed. Maintaining consistency while speed bag punching requires consistent rhythm and hand movement. This may be difficult to achieve, especially for beginners. Speed bag punching also generates repeated impact on the hands, wrists and arms, generally requires hand wraps or gloves, exercises only one arms at a time, may generate significant noise and vibration, and have other drawbacks.

Accordingly, there is a need for improved exercise equipment which provides for separate or simultaneous exercise of the upper body and the legs, and with the arms performing a speed bag type of movement. There is also a need for improved exercise equipment providing a speed bag punching type of movement, without one or more of the drawbacks of punching a speed bag.

SUMMARY

Exercise equipment includes first and second grip assemblies rotatably supported inside of a frame ring. Each grip assembly includes a bearing around a hand grip. A center spacer is positioned between the first and second grip assemblies. The center spacer and the first and second grip assemblies arranged on a common centerline. In use, with the hands on the hand grips, the user revolves the hand grips in a circular motion within the ring frame, simulating a speed bag punching type of movement.

A tubular grip sleeve may be provided around each bearing with the center spacer holding the grip sleeve of each grip assembly into rolling engagement with an inside surface of the frame ring.

In an alternative design, the frame ring may be provided as a stationery ring gear attached to a fixture. A sun gear centered is within the ring gear. First and second planetary gears are meshed with the ring gear and the sun gear. The first and second planetary gears and the sun gear aligned on a centerline of the ring gear. Hand grips are supported on a bearing on planetary gears. The first and second planetary gears revolve within the ring gear about the sun gear with the first and second hand grips remaining in an upright position, when grasped by the user.

BRIEF DESCRIPTION OF THE DRAWINGS

In the drawings, the same element number indicates the same element in each of the views.

DETAILED DESCRIPTION

Figure 1:
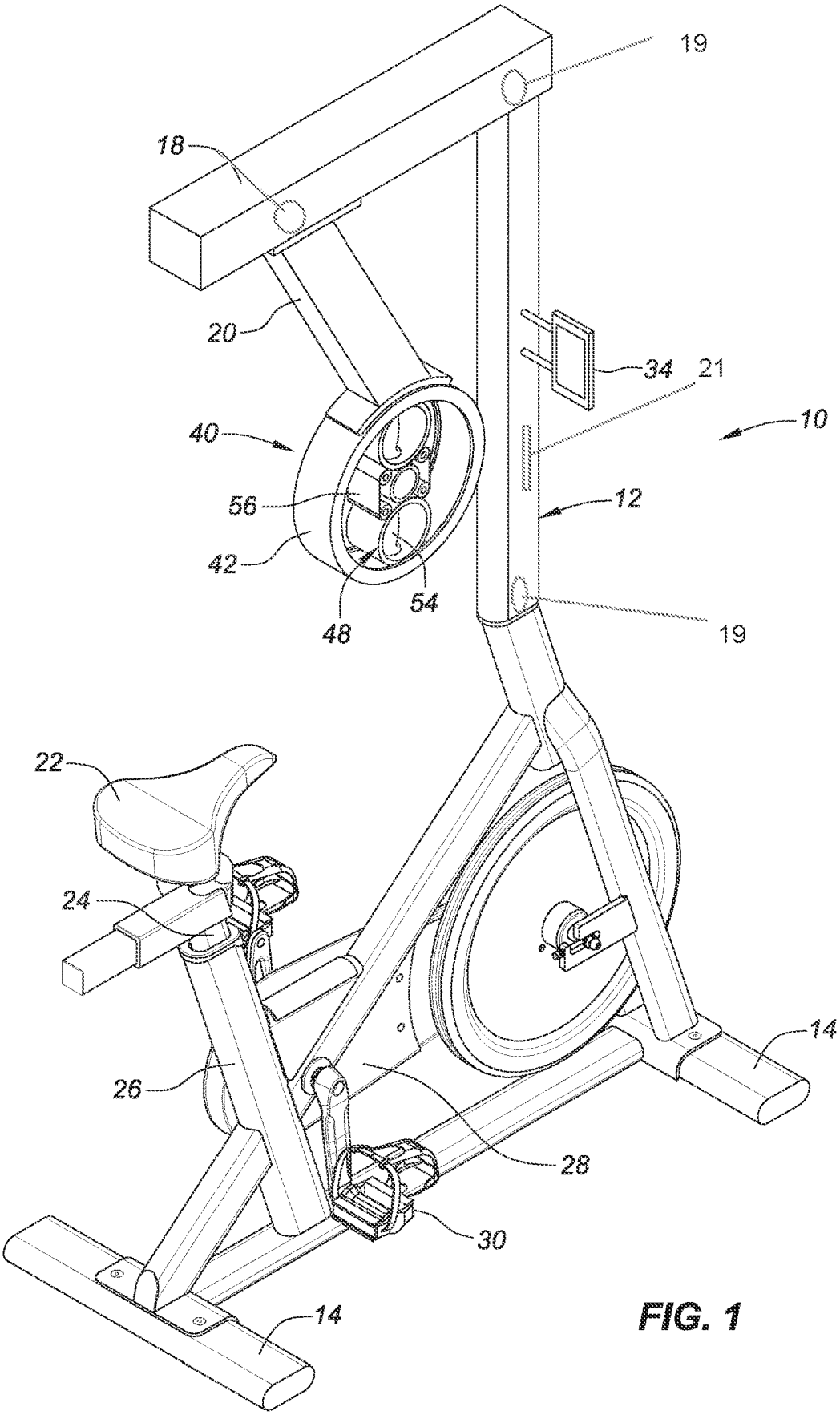
FIG. 1 is a schematic perspective view of exercise equipment.

As shown in FIG. 1, exercise equipment 10 includes an equipment frame 12 having a seat bar 24 attached to a diagonal 26. A set of bicycle pedals 30 and cranks are attached to a pedal gearbox 28 at the lower end of the seat bar. Legs 14 at the lower ends of the diagonal 26 and the seat bar 24 extend laterally to hold the equipment frame 12 steady and upright. A seat 22 is attached to an upper end of the seat bar 24. An arm unit 40 is supported on a frame arm 20 at an upper end of the equipment frame 12. The frame arm 20 may have an adjustable length to allow adjustment of the vertical position of the arm unit 40 relative to the seat 22. The frame arm 20 may be attached to the equipment frame 12 with a pivot joint 18 to allow the arm unit 40 to pivot towards and away from the seat 22. This allows the arm unit 40 to be appropriately positioned to better accommodate the users height and arm length. In general the height of the hands should be at eye level when the hands are revolving by using the equipment. The equipment 10 may be made foldable via connecting the seat bar and the diagonal to the equipment frame 12 via lockable pivot joints. Lockable pivot joints or separation joints 19 may be provided at other positions as well to allow the equipment frame 12 to be folded or dis-assembled for shipping or storage. A height adjuster 21 may be provided to adjust the height of the equipment frame and the height of the arm unit 40.

An electronic display 34 may be supported on the equipment frame 12 and electrically connected to the pedal gearbox 28 and/or the arm unit 40, to display speed, resistance, cadence, time, or other exercise parameters.

Figure 2:
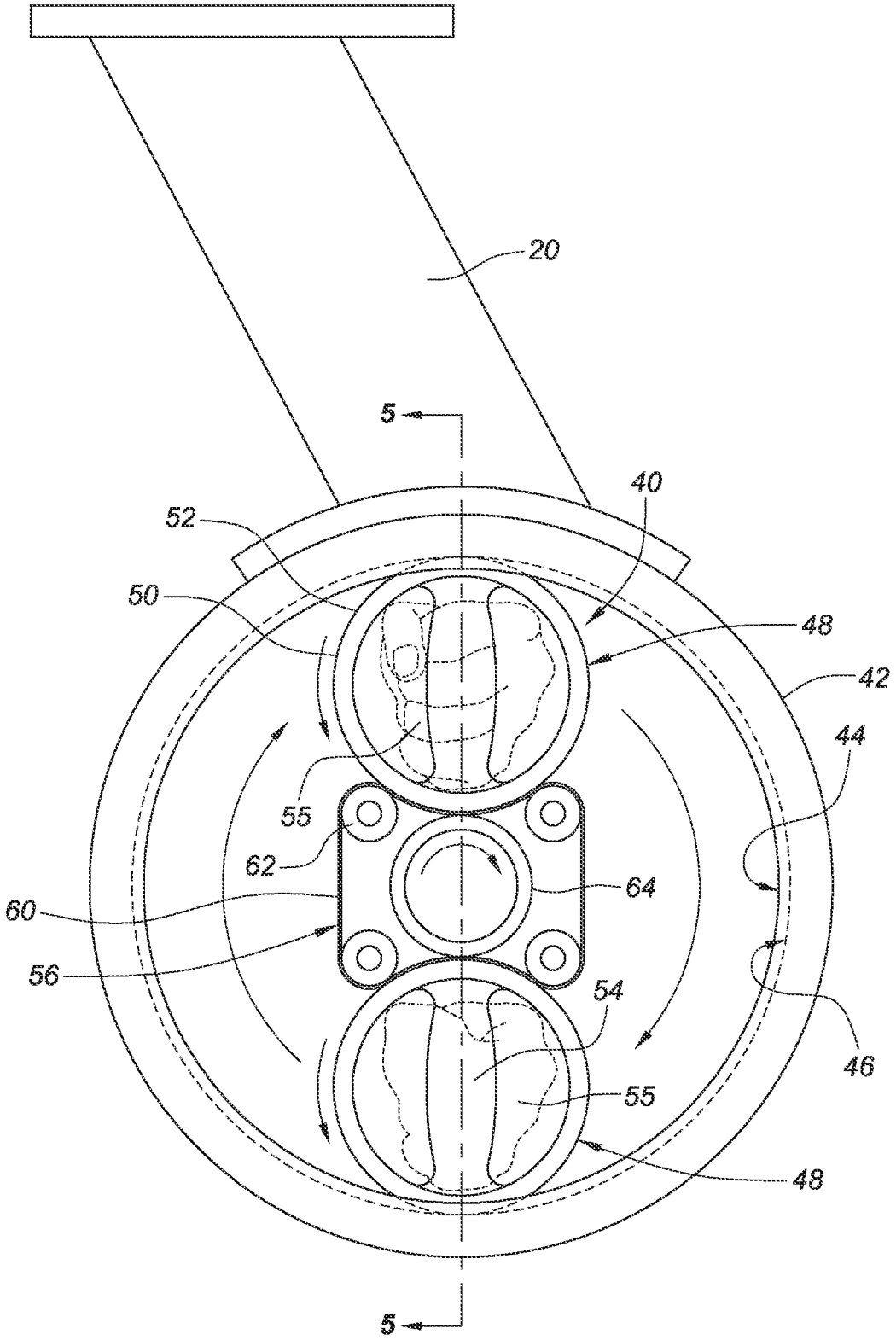
FIG. 2 is a side view of the arm unit shown in FIG. 1.
Figure 3:
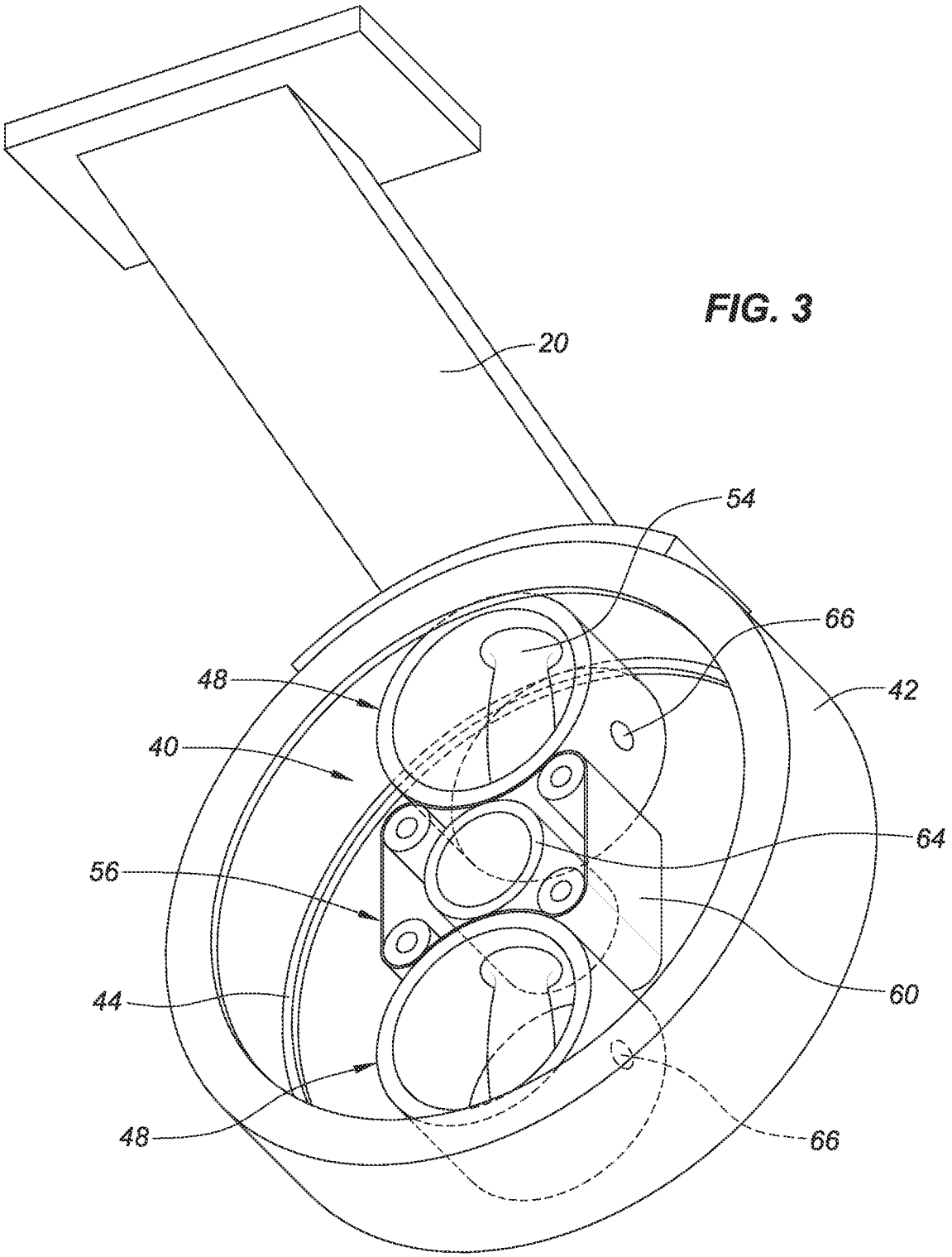
FIG. 3 is a perspective view of the arm unit shown in FIG. 2.
Figure 4:
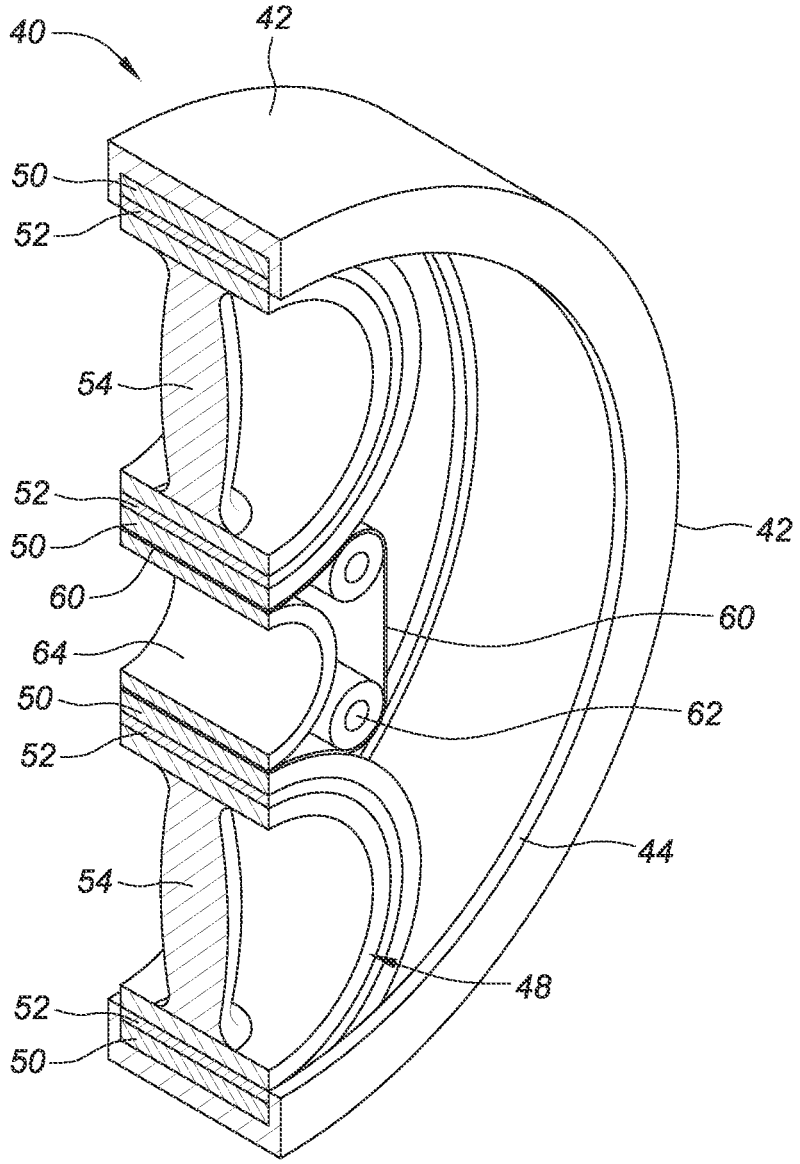
FIG. 4 is a perspective section view of the arm unit of FIG. 2.

Referring to FIGS. 2-5, in a first design, the arm unit 40 has a ring frame 42 which may be rigidly attached to the equipment frame 12, for use with the exercise equipment 10 of the type shown in FIG. 1. Alternatively, the arm unit 40 may be provided as a separate unit for attachment to other types of exercise equipment, or other structures, such as a stand, wall, ceiling, door, etc. Referring to FIGS. 2-4, the frame ring may have a uniform cylindrical outside surface and an inner diameter of about 24 to 48 cm. A bracket may be provided on an outside surface of the frame ring, similar to the frame arm 20, for attaching the frame ring to a fixture or supporting structure.

First and second grip assemblies 48 are inside of a frame ring 42. Each grip assembly 48 includes a bearing 52 around a hand grip 54. The bearing is within a grip sleeve 50. As shown in FIG. 3, the grip sleeve 50 may be a cylindrical tube segment. The hand grip 54 may be provided as a cylindrical tube segment having an ergo dynamic grip extending across a diameter of the tube segment. The bearing 52 allows the hand grip 54 to rotate within the grip sleeve 50 as the hand grip assemblies 48 revolve within the frame ring, as described below.

A center spacer 56 is positioned between the first and second grip assemblies 48. The center spacer 56 and the first and second grip assemblies 48 may be arranged on a common centerline. The center spacer 56 holds the grip assemblies 48 into engagement with inner surface of the frame ring 42. Different forms of the center spacer 56 may be used. FIGS. 2-5 show a center spacer 56 having a belt 60 looped around four corner rollers 62, optionally positioned at the corners of a rectangle, with the longer sides of the belt contacting the outside surface of the grip sleeve 50 of each hand grip assembly 48. A roller 64 may be provided within the loop of the belt 60 to better hold the belt 60 in position. The corner rollers 62 and the roller 64, if used, may be rotatably supported on a center frame or plates extending across a diameter of the frame ring 42, similar to the frame ring 80 shown in FIG. 6.

Referring to FIG. 3, a tensioner 66 may be provided on each grip assembly 48 to adjust the rotating friction of the hand grip 54 within the grip sleeve 50. This allows the frictional resistance of revolving the hand grips to be adjusted. Alternatively, a tensioner may be associated with the belt 60 and/or the roller 64 for this purpose. The hand grip 54 may be made of rubber or plastic, optionally with finger grooves or depressions, to provide a comfortable gripping surface. The frame ring 42 may have a rim 44 on each side extending radially inwardly to better maintain the grip assemblies 48 laterally in place as they revolve.

In the embodiment of FIGS. 3-5B, the grip sleeves 50 may have a smooth cylindrical outer surface which rolls against the inner surface of the frame ring 42 and against the belt 56. Alternatively, the outer cylindrical surface of the grip sleeves 50 may have cog or sprocket teeth that engage with a circumferential rack of complementary teeth on the inner surface of the frame ring 42. In this case, the belt 60 is provided as a toothed belt engaged with the sprocket teeth on the grip sleeves.

Figure 6:
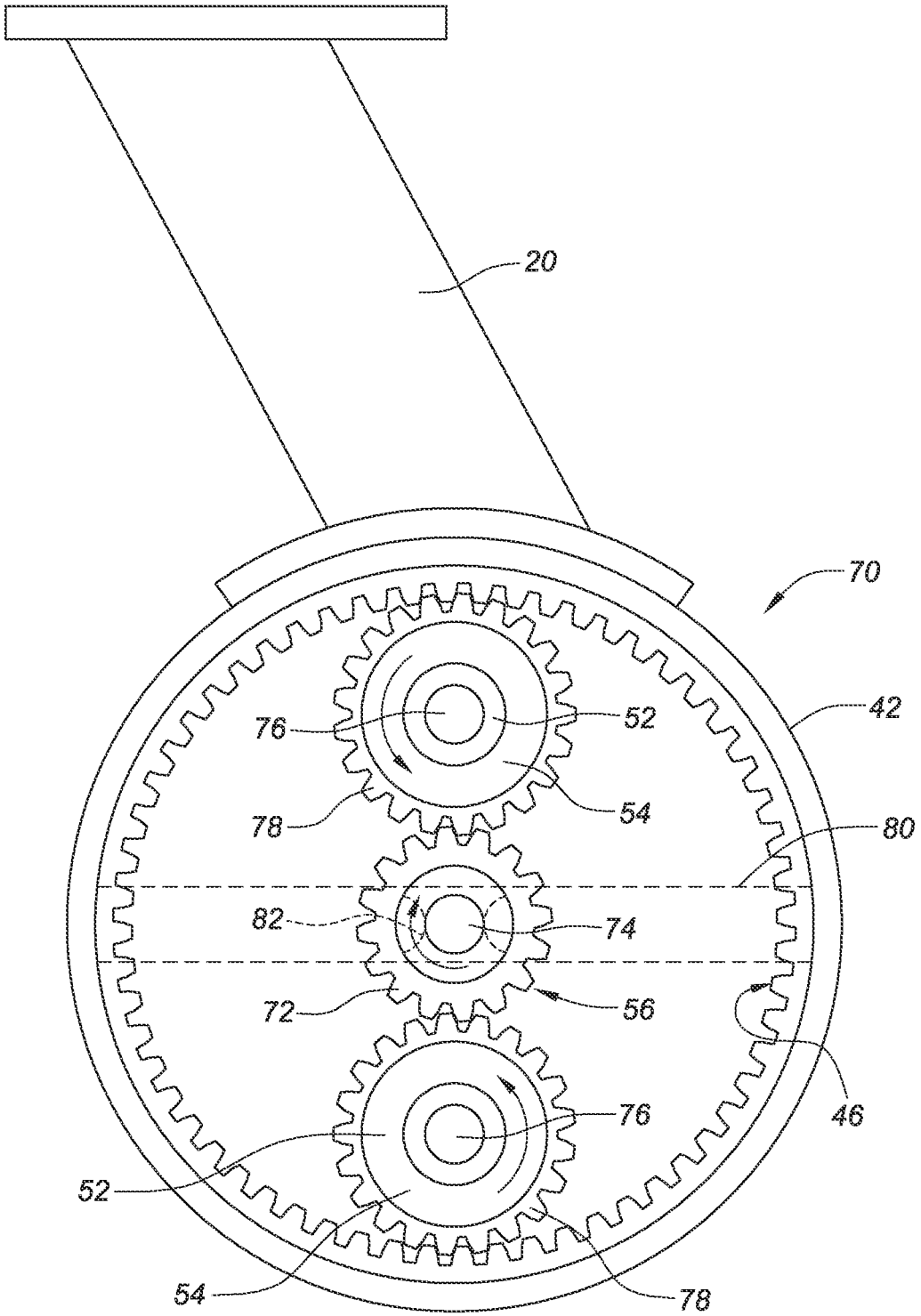
FIG. 6 is a side view of an alternative arm unit.

Turning now to FIG. 6, in an alternative design 70 the frame ring 42 includes, or is provided as, a ring gear 46. A sun gear 72 is mounted at the center of the ring gear 46. Each hand grip 54 is attached to a grip bearing 52 within a planetary gear 78. Each planetary gear 78 is meshed with the ring gear 46 and the sun gear 72. The sun gear 72 may be mounted on a sun gear hub 76 within a hub block 82 attached to a center frame 80. The ends of the center frame 80 may be attached to the frame ring 42 through slots in the ring gear 46, so as not to interfere with revolving movement of user's arms.

Figure 5A:
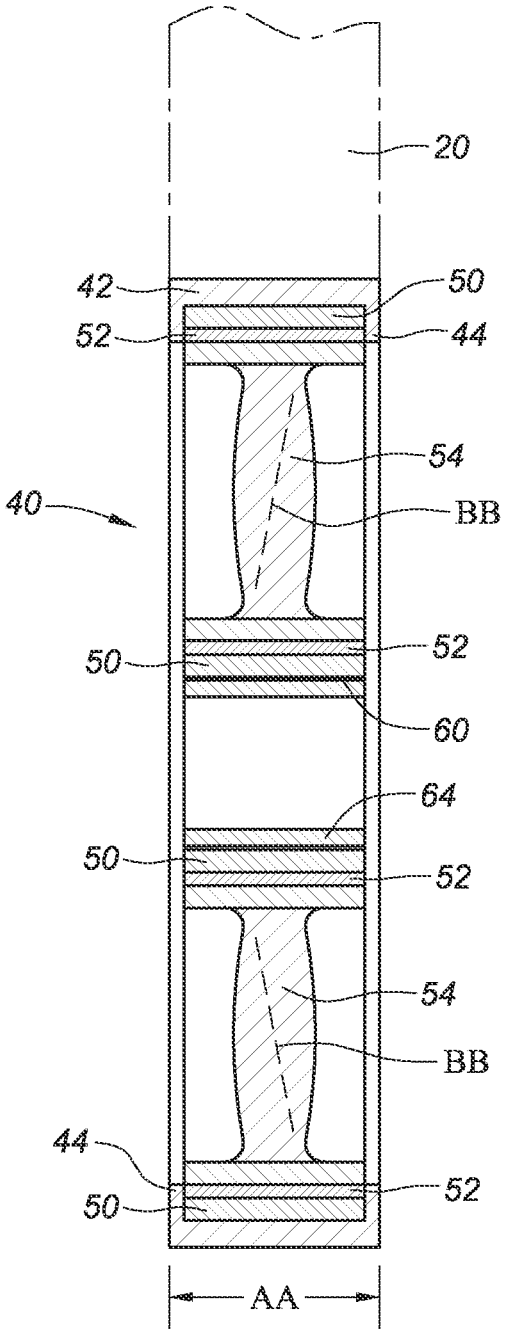
FIG. 5A is a section view taken along 5-5 of FIG. 2.
Figure 5B:
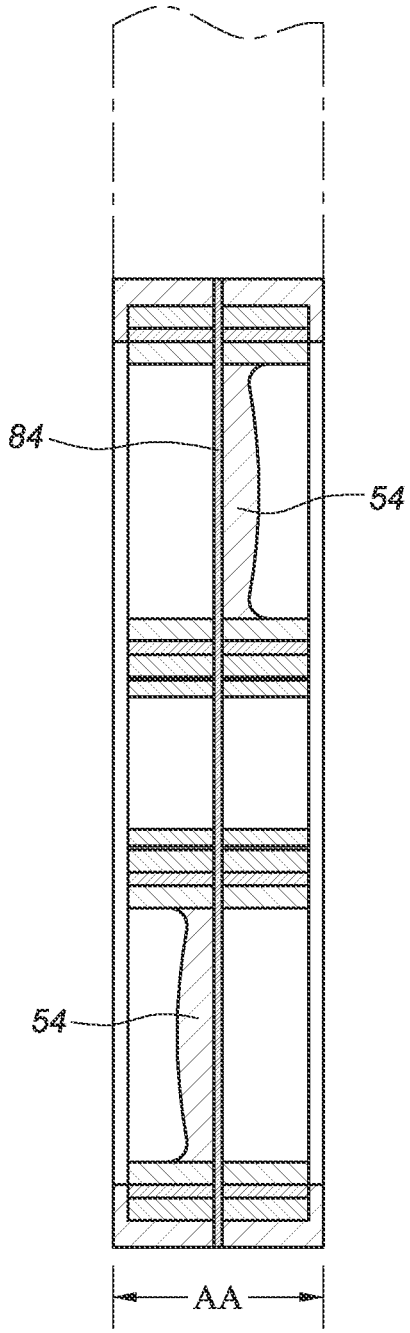
FIG. 5B is a section view of an alternative design.

The planetary gears 78, and optionally the sun gear 72, may optionally be mounted on a gear plate 84 to better maintain more precise gear centers, as shown in FIG. 5B. In this case the hand grips 54 may be laterally offset from each other sufficiently to provide clearance between them for the gear plate 84. In this case the first and second hand grip assemblies revolve in separate, laterally spaced apart parallel orbits or paths.

In a design using gears, exercise equipment includes a stationery ring gear 46 attached to a fixture, and a sun gear 72 centered within the ring gear. The first and second planetary gears 78 are each meshed with the ring gear and the sun gear. The first and second planetary gears and the sun gear aligned on a centerline of the ring gear. Left and right hand grips are supported on bearings on in the planetary gears. The planetary gears are revolvable within the ring gear about a center of the sun gear with the hand grips remaining in an upright position. The sun gear may be irrotatably attached to a sun gear hub mounted on a center frame extending across a diameter of the ring gear. The ring gear may have a first set of gear teeth laterally spaced apart from a second set of gear teeth, with the center frame attached to the ring gear between the first and second sets of gear teeth. The ring gear may be within a tubular ring frame having a width of 10 to 20 cm, with the hand grips entirely within the tubular ring frame.

Alternative gear based designs may also be used. For example, four planetary gears may be used to provide two sets of hand grips, allowing the user to choose between them. In this case, hand grip size or orientation may vary between the two pairs of hand grips. In other designs, an idler gear may be interposed between each planetary gear and the sun gear. Moreover, the design of FIG. 3 may be modified to include planetary gear teeth around the grip sleeves 50 meshed with ring gear teeth on the inside surface of the frame ring 42, as shown in dotted lines in FIG. 3.

Referring back to FIG. 3, the user grasps the hand grips 54 pushing and optionally also pulling, causing the hand grip assemblies 48 to revolve within the frame ring 42. The components revolve and rotate in the directions of the arrows in FIG. 2. The hand grips 54 may be centered laterally within the frame ring 42. Thus, in FIG. 3, the hand grips 54 are vertically aligned. During forward movement each hand grip approaches the front (or right side in FIG. 3) of the ring gear, with each hand grip at the same lateral position. This movement simulates a speed bag boxing movement of the user's hands and arms.

In use, with the hands on the hand grips, the user revolves the hand grips in a circular motion within the frame ring 42, simulating a speed bag punching type of movement. As shown in FIG. 3, the frame ring 42 may have a narrow width of e.g., 10 to 20 cm and the first and second hand grips are entirely within the frame ring 42. This causes the users hands to bend inwardly at the wrist, with the hands making a first as they grasp the hand grips. That is, the users hands reach laterally into the frame ring 42, rather than reaching out in a straight forward position. The axis BB of the hand grips shown in FIG. 5A may be vertical or tilt inwardly by about 10 to 30 degrees. In some designs, the hand grip axis may be adjustable.

If the arm unit 40 is combined onto the exercise equipment 10 shown in FIG. 1, the user may simultaneously operate the pedals 30, which operate like conventional bicycle type exercise equipment. In this way, the user can exercise the arms and the legs. This may be reduce required exercise time, and burn calories at a higher rate of calories.

Figure 7:
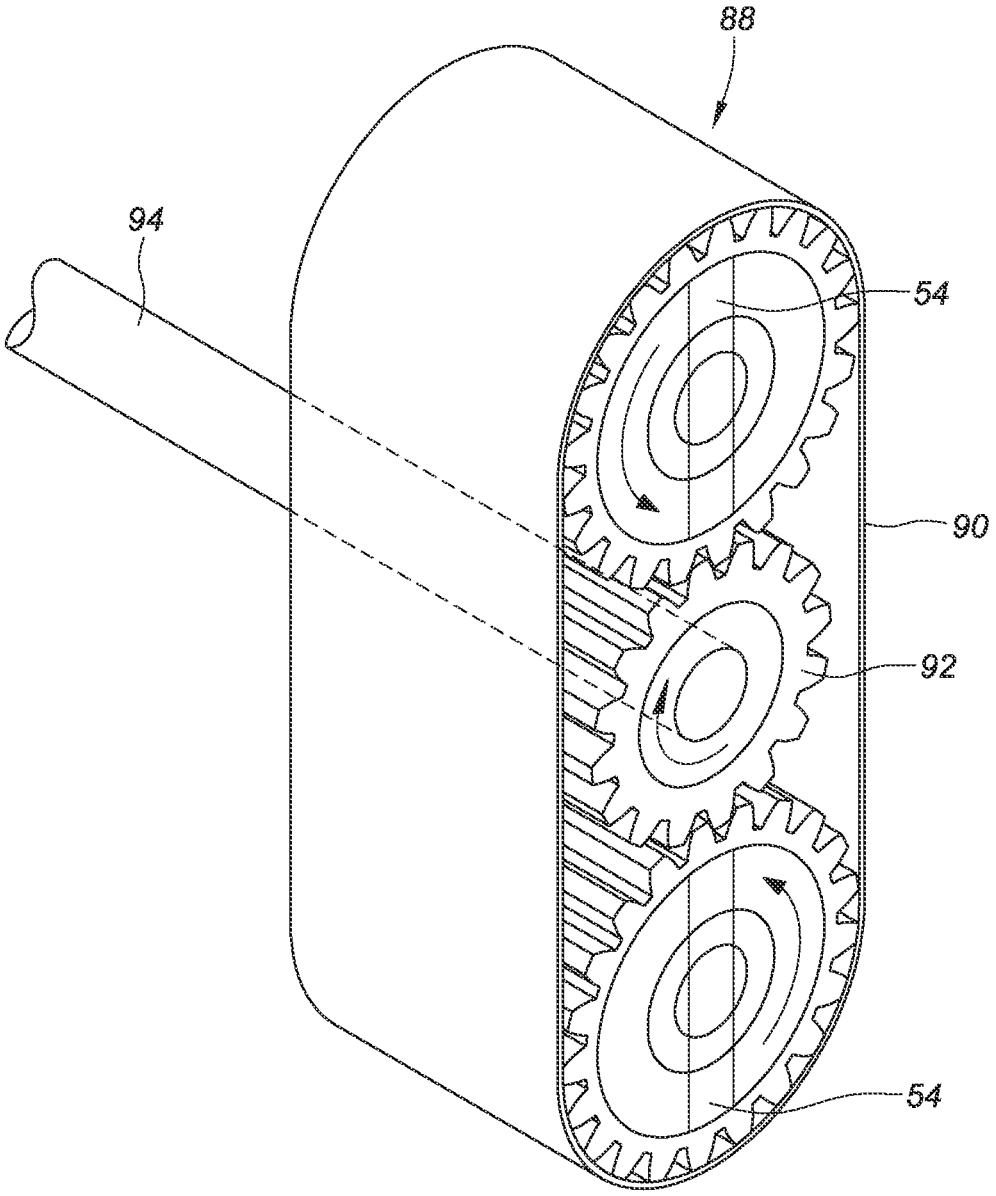
FIG. 7 is a schematic view of another alternative arm unit.

FIG. 7 shows another alternative arm unit 88 having a chain or belt 90 around planetary gears, sprockets or pulleys. In this case the sun gear, sprocket or roller 92 may be mounted on an armature 94 to support the arm unit 88, by attaching the armature 94 to a supporting structure. In this design, no frame ring 42 or ring gear 46 is used.

Figure 8:
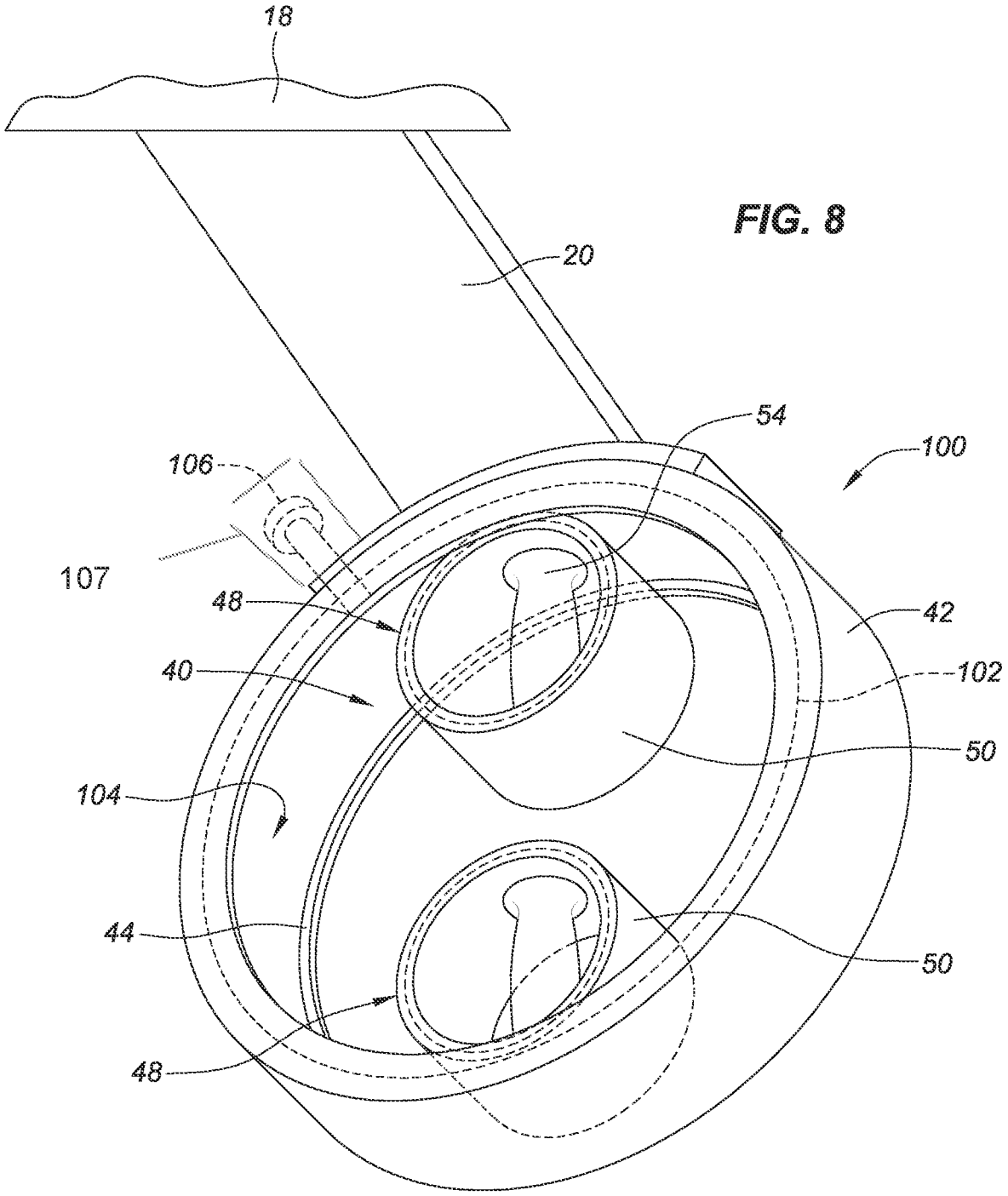
FIG. 8 is a perspective view of another alternative arm unit.

FIG. 8 shows another alternative arm unit 100 having no center spacer 56. In this embodiment each handgrip 54 is mounted on or in a bearing 52 within a grip sleeve 50, as in the embodiment shown in FIGS. 4 and 5A. A ring bearing 102 is positioned within the ring frame 42, with the outer race of the ring bearing 102 rigidly attached to the inner surface and/or rim 44 of the ring frame 42. Each grip sleeve 50 is rigidly attached to the inner race of the ring bearing 102. The grip assemblies 48 revolve around the open center area of the ring frame 42 as the user pushes and/or pulls on the handgrips 54, which remain upright. An automated tensioner 106 may be provided to adjust the rotating resistance of the ring bearing. If the automated tensioner 106 is used instead of a manual tensioner 66, an electrically powered controller 107 may operate the automated tensioner 106, in response to voice commands. This allows the user to adjust the rotating resistance without removing hands from the hand grips. The controller 107 may also operate the automated tensioner 106 in response to a preset program. A manual or an automated tensioner 106, with or without voice command response, may be used on any of the embodiments described.

Figure 9:
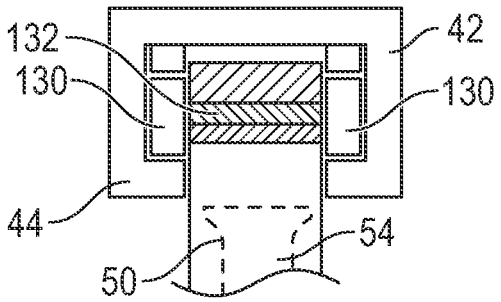
FIG. 9 is a schematic section view of a bearing design which may be used in the alternative arm unit shown in FIG. 8.

Of course, alternative bearing designs may be used to allow the handgrips 54 to remain upright or in a substantially fixed orientation while the grip sleeves 50 revolve within the ring frame 42. For example, as shown in FIG. 9, a pin 132 may extend laterally through the cylindrical wall of the grip sleeve 50. A bearing 130, such as a roller bearing or a sliding bearing, is attached to each projecting end of the pin 132. The bearings 130 are captive within the ring frame 42. The bearings 130 allow the handgrips 54 to revolve within the ring frame with low friction. The ring frame 42 may optionally be provided as a round through hole opening in the frame arm 20, rather than as a separate element attached to the frame arm 20.

In the designs of FIGS. 2-5A, the handgrips are shown as aligned laterally on the same centerline. This provides a speedbag type of hand and arm movement. The handgrips may optionally be laterally off set from each other. This reduces the angle of the user's wrists reaching in to grasp the handgrips, which may be preferred by some users. The lateral positions of the handgrips may also be made adjustable via threaded end fittings extending through slots, or in other ways.

Figure 10:
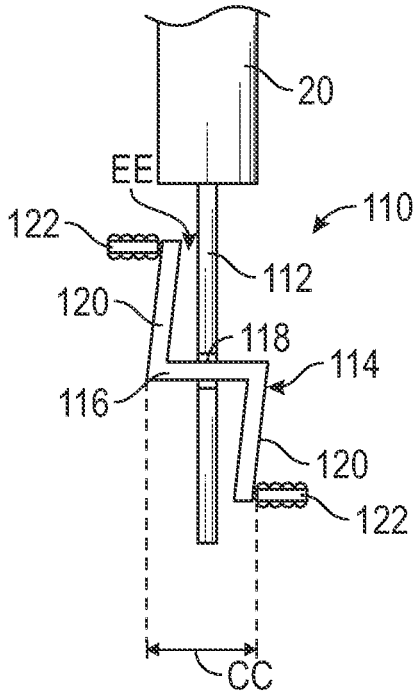
FIG. 10 is a perspective view of another alternative arm unit.
Figure 11:
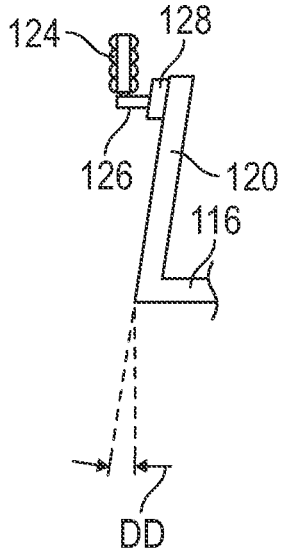
FIG. 11 is a schematic rear view of a modification of the arm unit shown in FIG. 10.

As shown in FIG. 10, an arm unit 110 may have a center plate 112 extending down from the frame arm 20. A crank 114 is rotatably supported on the center plate 112 via a shaft 116 of the crank 114 extending through a bearing 118. Inner ends of left and right crank arms 122 are attached to, or part of, the shaft 116. The crank arms 122 extend radially outward from the shaft 116 in opposite directions. Referring also to FIG. 11, the crank arms 122 and may be parallel to each other, and at an angle DD to the shaft 116 of about 5 to 30°, typically about 10 to 20°. In FIG. 10, horizontal hand grips 122 are rotatably attached to the outer end of each crank arm 120. In use, the user grasps the hand grips 12 and rotates the crank 114, similar to pedaling a bicycle. The circular orbits of the hand grips 12 are closely spaced together due to the angle DD of the crank arms 120. The length of the shaft 116 may be limited to less than e.g., 6, 8, 10 or 12 cm. The center plate 112 may be only e.g., 5 to 25 mm or 6 to 15 mm thick. The clearance space or gap EE between the center plate 112 and the outer ends of the crank arms 120 may be minimized to 1 to 10, 2 to 8, or 3 to 7 mm. As a result, the orbits of the centerlines of the hand grips 12 may be less than e.g., 20, 18, or 16 cm apart. The circular movement of the users hands on the hand grips 12 is consequently similar to a speed bag punching movement. Any of the arm units may be provided as a separate unit for attachment to other types of exercise equipment, or other structures, such as a stand, wall, ceiling, door, etc.

Figure 12:
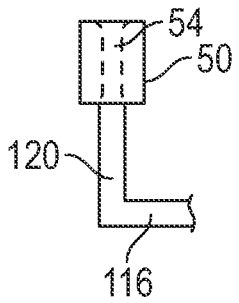
FIG. 12 is a schematic rear view of another modification of the arm unit shown in FIG. 10.
Figure 13:
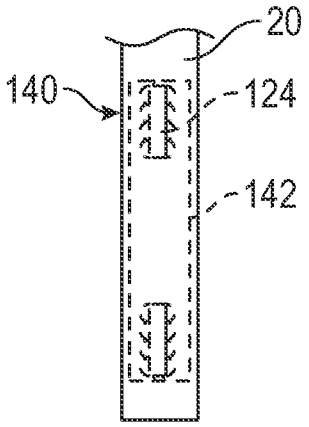
FIG. 13 is a schematic rear view of another arm unit.

In FIG. 11, vertical handgrips 124 are rotatably attached to the outer ends of the crank arms 122 via a connector shaft 126 supported on a bearing 128. In this design, the users hands are vertical instead of horizontal as in FIG. 10. The designs in FIGS. 10 and 11 may have a tensioner to adjust rotating resistance, as described above. FIG. 12 shows a design similar to FIG. 10, but with the handgrips 122 in grip sleeves 50 attached to ends of the crank arms 120. FIG. 13 shows a design where an entire arm unit 140 is contained within the width of the frame arm 20. Handgrips 124 are rotably attached to a plate or ring 142 rotatably supported within a lateral opening in the frame arm 20. Grip sleeves 50 may be omitted because the position of the handgrips 124 within the envelope of the frame arm 20 positions the users hands appropriately for a speed bag type of movement.

In the designs described above, the peddle-like movement of the hand grips keeps the users hands either rotating over each other, similar to having both hands or fists striking the same position on a speed bag, or keeping the users hands laterally very close together. Although the users hands rotate over each other or laterally close to each other, the apparatus is configured so that the users hands (and arms) contact only the hand grips and no other parts of the apparatus. The apparatus may be dimensioned or adjusted so that the users hands are at eye level when rotating. The seat and/or the arm unit may be vertically and horizontally adjustable. Elements of any one of the embodiments described above may used in the other embodiments as well, as apparent to a person of skill in the art.

Thus, novel equipment and methods have been shown and described, Various changes may of course be made without departing from the spirit and scope of the invention. The invention, therefore, should not be limited, except by the following claims and their equivalents.

I claim:

1. Exercise equipment, comprising:

an equipment frame;

a frame ring supported on the equipment frame;

first and second grip assemblies rotatably supported inside of the frame ring;

each grip assembly including a bearing around a hand grip;

the grip assemblies in use revolvable within the frame ring about a fixed axis of the frame ring, with the hand grips remaining upright.

2. The exercise equipment of claim 1, further including a center spacer between the first and second grip assemblies, a tubular grip sleeve around each bearing, wherein the center spacer holds the tubular grip sleeve of each grip assembly into rolling engagement with an inside surface of the frame ring.

3. The exercise equipment of claim 2, wherein the center spacer comprises a belt extending around four corner rollers within the frame ring, with opposite sides of the belt engaging an inner segment of each grip sleeve, the belt rotating around idlers as the grip assemblies revolve around the frame ring.

4. The exercise equipment of claim 3, further including a roller at a center of the frame ring.

5. The exercise equipment of claim 2, wherein each grip sleeve has an outer diameter of 9 to 14 cm.

6. The exercise equipment of claim 5, wherein the frame ring has an inner diameter of 24 to 48 cm.

7. The exercise equipment of claim 2, wherein the frame ring has left and right rims laterally holding the grip sleeves within the frame ring.

8. The exercise equipment of claim 1, wherein the first and second grip assemblies arranged on a common vertical centerline.

9. The exercise equipment of claim 1, wherein the hand grips are less than 20 cm apart.

10. The exercise equipment of claim 1, wherein the frame ring is round.

11. Exercise equipment, comprising:

an equipment frame;

a seat attached to the equipment frame;

a set of pedals rotatably supported on the equipment frame;

an arm unit on the equipment frame, the arm unit including:

a round frame ring, first and second grip assemblies rotatably supported inside of the round frame ring, each grip assembly including a bearing around a hand grip, and the grip assemblies movable in a circle with the grip assemblies remaining upright.

12. The exercise equipment of claim 11, wherein the grip assemblies are revolvable within the frame ring on a fixed axis.

13. The exercise equipment of claim 11, wherein the first and second grip assemblies arranged on a common vertical centerline.

14. The exercise equipment of claim 11, wherein the hand grips are less than 20 cm apart.

15. The exercise equipment of claim 11, wherein each bearing is within a tubular grip sleeve.

16. Exercise equipment, comprising:

an equipment frame;

a frame ring attached to the equipment frame;

first and second grip assemblies rotatably supported inside of the frame ring, the first and second grip assemblies on a common vertical centerline;

each grip assembly including a bearing around a hand grip; and the grip assemblies revolvable within the frame ring about a center of the frame ring, with the hand grips remaining upright.

17. The exercise equipment of claim 16, wherein the grip assemblies are revolvable within the frame ring on a fixed axis.

18. The exercise equipment of claim 16, wherein the frame ring is round.

19. The exercise equipment of claim 16, wherein each bearing is within a tubular grip sleeve.

20. Exercise equipment, comprising:

a round frame ring having an inner surface;

first and second grip assemblies rotatably supported inside of the frame ring;

each grip assembly including a bearing around a hand grip;

the grip assemblies revolvable around the inner surface of the frame ring about a center of the frame ring, with the hand grips remaining upright; and a tensioner for adjusting a revolving resistance of each hand grip within the frame ring.

21. The exercise equipment of claim 20, the hand grips are aligned on a common vertical centerline.

22. The exercise equipment of claim 20, wherein the hand grips are less than 20 cm apart.

23. The exercise equipment of claim 20, wherein the grip assemblies are revolvable within the frame ring on a fixed axis about a center of the frame ring.

* * * * *